US010953649B2

(12) United States Patent
Brudermann et al.

(10) Patent No.: US 10,953,649 B2
(45) Date of Patent: Mar. 23, 2021

(54) SQUEEGEE

(71) Applicant: DAETWYLER SWISSTEC AG, Bleienbach (CH)

(72) Inventors: Hans Jörg Brudermann, Zollikofen (CH); Michael Reinert, Lübeck (DE)

(73) Assignee: DAETWYLER SWISSTEC AG, Bleienbach (CH)

( * ) Notice: Subject to any disclaimer, the term of this patent is extended or adjusted under 35 U.S.C. 154(b) by 57 days.

(21) Appl. No.: 15/776,001

(22) PCT Filed: Dec. 9, 2016

(86) PCT No.: PCT/EP2016/080473
§ 371 (c)(1),
(2) Date: May 14, 2018

(87) PCT Pub. No.: WO2017/097995
PCT Pub. Date: Jun. 15, 2017

(65) Prior Publication Data

US 2018/0319154 A1 Nov. 8, 2018

(30) Foreign Application Priority Data

Dec. 10, 2015 (EP) ..... 15199303

(51) Int. Cl.
*B41F 9/10* (2006.01)

(52) U.S. Cl.
CPC ..... *B41F 9/1072* (2013.01)

(58) Field of Classification Search
CPC ..... B41F 9/1072
(Continued)

(56) References Cited

U.S. PATENT DOCUMENTS 5,632,668 A * 5/1997 Lindholm ..... B24B 13/01 451/296
6,305,282 B1 * 10/2001 Datwyler ..... B41F 9/1072 101/154

(Continued)

FOREIGN PATENT DOCUMENTS

EP 0911157 A1 4/1999
JP 2004-34301 A 2/2004

(Continued)

OTHER PUBLICATIONS

International Preliminary Report on Patentability and Written Opinion of the International Searching Authority (forms PCT/IB/373 and PCT/ISA/237), dated Jun. 12, 2018, for International Application No. PCT/EP2016/080473.

(Continued)

*Primary Examiner* — Anthony H Nguyen
(74) *Attorney, Agent, or Firm* — Birch, Stewart, Kolasch & Birch, LLP

(57) ABSTRACT

A doctor blade (100), in particular for doctoring off printing ink from an impression cylinder, comprises a doctor blade body (110) with a working edge (130) and a first doctor blade side (122) which faces the impression cylinder, in particular, during operation, and a second doctor blade side (121) which faces away from the impression cylinder, in particular, during operation. The doctor blade body (110) is provided with a coating (150) which comprises a polymer, wherein the coating (150) comprises particles (160) at least in one part region. The particles (160) are configured as hard material particles (160), and a mass proportion of the hard material particles (160) in the coating (150) on the first doctor blade side (122) is higher than a mass proportion of the hard material particles (160) in the coating (150) on the second doctor blade side (121).

24 Claims, 2 Drawing Sheets

(58) Field of Classification Search
USPC ..... 101/169
See application file for complete search history.

(56) References Cited

U.S. PATENT DOCUMENTS

| | | | | |
|---|---|---|---|---|
| 6,841,264 | B2 * | 1/2005 | Lunnerfjord | B05C 11/045 101/157 |
| 9,132,687 | B2 | 9/2015 | Brudermann et al. | |
| 2002/0157548 | A1 * | 10/2002 | Beran | C22C 38/04 101/169 |
| 2007/0017392 | A1 * | 1/2007 | Filippini Fantoni | B41N 10/005 101/157 |
| 2009/0308270 | A1 * | 12/2009 | Cansler | D21G 3/005 101/169 |
| 2010/0089263 | A1 * | 4/2010 | Sato | B41F 9/10 101/169 |
| 2013/0174779 | A1 * | 7/2013 | Bischof | D21G 3/005 118/123 |
| 2015/0299514 | A1 * | 10/2015 | Chiu | E21B 17/1085 175/325.1 |

FOREIGN PATENT DOCUMENTS

| | | | |
|---|---|---|---|
| JP | 2013-517161 | A | 5/2013 |
| WO | WO 02/46526 | A1 | 6/2002 |
| WO | WO 2013/133762 | A1 | 9/2013 |

OTHER PUBLICATIONS

International Search Report, issued in PCT/EP2016/080473, PCT/ISA/210, dated Jan. 26, 2017.
Search Report issued in European priority application 15199303.7, dated Jun. 13, 2016.
Written Opinion of the International Searching Authority, issued in PCT/EP2016/080473, PCT/ISA/237, dated Jan. 26, 2017.

* cited by examiner

SQUEEGEE

CROSS REFERENCE TO RELATED APPLICATIONS

This application is the National Phase of PCT/EP2016/080473 filed on Dec. 9, 2016, which claims priority under 35 U.S.C. § 119(a) to Patent Application No. 15199303.7 filed in Europe on Dec. 10, 2015, all of which are hereby expressly incorporated by reference into the present application.

TECHNICAL FIELD

The invention relates to a squeegee comprising a squeegee body having a working edge and a first squeegee side which especially faces a printing cylinder in operation and a second squeegee side which especially faces away from the printing cylinder in operation, where the squeegee body has been provided with a coating comprising a polymer, where the coating comprises particles at least in one subregion. The invention further relates to a process for producing such a squeegee.

STATE OF THE ART

Squeegees are used in the printing industry and also in papermaking.

In the printing industry, squeegees are especially used for stripping excess printing ink off the surfaces of printing cylinders or printing rollers. Particularly in the case of intaglio printing and flexographic printing, the quality of the squeegee has a crucial influence on the printing outcome. Unevenness or irregularities of the working edges of the squeegee in contact with the printing cylinder lead, for example, to incomplete stripping of the printing ink off the lands of the printing cylinders. This can result in uncontrolled release of printing ink on the print substrate.

During the stripping, the working edges of the squeegee are pressed against the surfaces of the printing cylinders or printing rollers and are moved relative thereto. Thus, the working edges, especially in the case of rotary printing machines, are firstly subjected to high mechanical stresses which entail corresponding wear; secondly, high demands are placed on the working edges of the squeegee, such that precise stripping is ensured over a maximum period of application. Squeegees are therefore fundamentally consumable articles which have to be exchanged periodically. The aim is therefore, particularly with constantly high quality of the squeegee, to keep the production costs low and the lifetime simultaneously at a maximum.

Squeegees are usually based on a squeegee body made of steel or plastic with a specially shaped working edge. In order to improve the lifetime of the squeegee, the working edges of the squeegee can additionally be provided with coatings or coverings composed of plastics, lacquers and/or metals. The physical characteristics of the coatings have a crucial effect in particular on the mechanical and tribological properties of the squeegee. Squeegees of this kind are known from the prior art.

A squeegee of this kind is described, for example, in EP 0 911 157 B1. This relates to a squeegee for squeegeeing excess printing ink off the surface of a printing plate. In order to minimize wear on the surface of the printing plate in contact with the squeegee, the lamella and also the region of the rear squeegee portion adjoining the lamella are provided, over the entire squeegee length, with a coating consisting of lubricant or at least including lubricant particles. The coating may comprise a carrier material in which both lubricant particles and particles of a wear-resistant material are embedded.

However, squeegees coated in such a way are still not completely satisfactory in relation to production costs and precision in stripping.

In the paper industry, squeegees, according to the application, are particularly also referred to as coating knives, coating blades or scrapers. With a coating knife or coating bar, it is possible, for example, to remove excess coating color (for example pigments, binders, additives, etc.) from a paper substrate or a paper web. As in the printing industry, the lifetime of the coating knives, coating blades or scrapers can be improved by providing the working edges of the squeegee with coatings or coverings of plastics, lacquers and/or metals. In the field of squeegees for the paper industry or for papermaking too, however, the known systems are not completely satisfactory. There is therefore still a need for improved squeegees that do not have the disadvantages mentioned above.

SUMMARY OF THE INVENTION

It is an object of the invention to provide a squeegee for the technical field cited at the outset which are usable very advantageously at low production costs for applications in the printing industry or in papermaking. In particular, the squeegees should be usable for applications in the printing industry and enable very exact stripping-off of printing ink.

The way in which the object is achieved is defined by the features of claim 1. According to the invention, the particles take the form of hard material particles and a proportion by mass of the hard material particles in the coating on the first squeegee side is higher than a proportion by mass of the hard material particles in the coating on the second squeegee side.

The first squeegee side, especially the side facing the printing cylinder, comprises at least the contact region between squeegee and printing roller or paper substrate during an application, for example in the squeegeeing-off of printing ink. Moreover, the second squeegee side, especially the side of the squeegee facing the printing cylinder, comprises the surface of the squeegee which forms an angle of less than 90° with a tangent to the printing roller or to the paper substrate in the contact region with the squeegee. In other words, the side of the squeegee facing the printing roller or the paper substrate is that surface of the squeegee accessible directly, i.e. without passing through the squeegee, by an extended radius of the printing roller or the paper substrate. In the case of a flat paper substrate, the radius corresponds to a surface normal of the paper substrate.

In a process for producing such a squeegee, in a squeegee body with a working edge, a first squeegee side which especially faces the printing cylinder in operation and a second squeegee side which especially faces away from the printing cylinder in operation is coated with a coating comprising a polymer and comprising particles at least in one subregion. These particles take the form of hard material particles and a proportion by mass of the hard material particles in the coating on the first squeegee side is higher than a proportion by mass of the hard material particles in the coating on the second squeegee side.

The term "squeegee" in the present context should be understood broadly and encompasses squeegees both for applications in the printing industry and in the paper industry. More particularly, the squeegees are printing squeegees, coating knives, coating blades and/or scrapers. In a particularly preferred embodiment, the squeegee is a printing squeegee specifically intended for squeegeeing printing ink off a printing cylinder.

The squeegee body preferably has an elongated form and may take the form, for example, of a strip, with the working edge oriented in a longitudinal direction of the strip. According to the strength, material and dimensions of the squeegee body, it may take the form, for example, of a roll of strip material.

The coating comprising a polymer comprises preferably more than 50% by weight (percent by weight) of polymers, especially more than 75% by weight of polymers, more preferably more than 90% by weight of polymers. Moreover, the polymer content is preferably less than 99% by weight, more preferably less than 95% by weight. Polymers are thus preferably the main constituent of the coating. The aforementioned proportions of the polymers in the coating are based on the coating of the ready-to-use squeegee. The coating comprising a polymer may in these cases also be referred to as polymer-based coating.

Before being applied to the squeegee body, the coating comprising the polymer, owing to solvents or other volatile substances, may have a lower proportion by mass of hard material particles than on the squeegee body in the ready-to-use state of the squeegee. By a drying step during the production of the squeegee, it is possible to remove such volatile substances.

In particular, the polymer in the coating forms a continuous phase and/or a dispersion medium for the hard material particles in the coating. The hard material particles here are especially dispersed and/or embedded in the continuous phase of the polymer.

In the present context, the polymer comprises or consists especially of an organic polymer. The polymer may be a homopolymer or a copolymer. Homopolymers consist essentially of a single type of monomer, whereas copolymers consist of two, three or even more chemically different monomer types. It is also possible that the polymer, in the form of a "polymer blend" or of a mixture, consists of two or more different homopolymers and/or copolymers.

In particular, the polymer is a thermoset, thermoplastic and/or an elastomer. Preference is given, for example, to thermosets. After they have cured, thermosets have three-dimensional crosslinking and typically cannot be deformed again after they have cured. Thermosets in the present context have been found to be particularly robust and simultaneously surprisingly advantageous in relation to the sliding and stripping properties.

Polymers envisaged may, for example, be epoxy resins, phenolic resins, such as phenol-formaldehyde resins (novolaks and resols), melamine-formaldehyde resins and saturated and unsaturated polyester resins or mixtures thereof. The polymers may further include rubber, polyurethanes, polyureas, thermoplastics or mixtures thereof. The thermoplastics may include, for example, acrylonitrile-butadiene-styrene, polyamide, polycarbonate, polyethylene, polypropylene, polystyrene, polyvinyl chloride or mixtures thereof. The person skilled in the art is also aware of further possible polymers which may be provided in pure form or as mixtures for the production of the coating. The polymer mixtures may especially comprise two or more different polymers.

In variants, the coating may also comprise less than 50% by weight of polymer.

When the polymer in the coating forms a continuous phase and/or the dispersion medium for the hard material particles, the continuous phase formed by the polymer and/or the dispersion medium formed by the polymer advantageously includes less than 50% by weight, especially less than 25% by weight, preferably less than 10% by weight, in particular less than 5% by weight, even more preferably less than 2% by weight or less than 1% by weight, of a metal. Most preferably, the continuous phase and/or the dispersion medium for the hard material particles in the coating is essentially free of metals. "Metal" especially means metallically bonded metal atoms. In particular, individual metal ions, metal salts or covalently bonded metals are not covered by the term "metal". The metal in this case is especially nickel, chromium, tin, alloys of nickel and chromium, alloys of nickel and tin and/or alloys of nickel and phosphorus, in particular nickel and/or alloys of nickel and phosphorus.

In a preferred embodiment, the coating comprising a polymer especially includes a total of less than 50% by weight, advantageously less than 25% by weight, preferably less than 10% by weight, in particular less than 5% by weight, even more preferably less than 2% by weight or less than 1% by weight, of a metal. Most preferably, the coating comprising a polymer is essentially free of metals.

In particular, each of the coatings of the squeegee has a proportion of metal of less than 50% by weight, advantageously less than 25% by weight, preferably less than 10% by weight, in particular less than 5% by weight, even more preferably less than 2% by weight or less than 1% by weight. Most preferably, all coatings of the squeegee are essentially free of metals.

Through the reduction in the proportions of metal or the omission of metals, it is possible to simplify the production processes for the squeegee. It has been found here that, surprisingly, polymer-comprising coatings or polymer-based coatings can be used in place of metal-based coatings without significant losses in relation to the quality of the squeegee.

The coating comprising a polymer advantageously forms the outermost coating of the squeegee at least in the region of the working edge, preferably in all coated regions of the squeegee. Thus, in each case, the coating of the squeegee that comprises a polymer, on use, is directly in contact with the printing plate or a paper substrate, which results in the best possible effect.

The hard material particles typically serve to improve the wear characteristics of the squeegee, but can also cause other effects. For this purpose, the hard material particles are preferably dispersed in a coating in which the polymer(s) are also present.

The hard material particles are each advantageously distributed homogeneously in the coating on the first squeegee side and on the second squeegee side. The coating thus has a heterogeneous structure owing to the dispersed hard material particles. The coating can be applied on the squeegee body, for example, as a varnish by squirting it on, spraying, rolling, painting or in some other way.

According to the invention, the two squeegee sides of the squeegee have coatings having different proportions by mass of hard material particles. It is thus possible for the hard material particles to occur in greater concentrations where elevated stress on the squeegee is to be expected. It is thus possible to use the hard material particles in an economical manner, especially since the hard material particles are preferably more significantly represented in the region of the greatest stress on the squeegee, and so hard material particles can be saved in the regions of the squeegee subject to less stress. It is thus possible to keep the production costs low with essentially constant quality of the squeegee. At the same time, the other side of the squeegee, owing to the reduced proportions by mass of hard material particles, has higher homogeneity and improved adhesion on the squeegee body. Overall, it is thus especially also possible to achieve more homogeneous wear of the coating of the squeegee.

The first squeegee side, which especially faces the printing cylinder or the paper in operation, preferably comprises an end face of the working edge which rests against the printing cylinder or a paper substrate in operation. It is thus possible for the coating to be provided with the higher proportion by mass of hard material particles exactly where the highest stress on the squeegee takes place. Alternatively, the coating having the higher proportion by mass of hard material particles may extend further on the first side and especially also cover the entire first squeegee side. In a preferred embodiment, the coating having the higher proportion by mass of hard material particles, however, covers at least the end face of the working edge and hence at least a subregion of the first squeegee side, preferably more than 20%, more preferably more than 50%, further preferably more than 70%, of the surface of the first squeegee side. More preferably, the coating covers at least the entire working edge. Further preferably, the coating, in addition to the working edge, covers a further subregion of the squeegee peripheral to the working edge.

The second squeegee side especially comprises the side facing away from the printing cylinder or the paper in operation. A transition between the coatings of the first squeegee side and the second squeegee side may be fluid, in which case, for example, both coatings are applied before the squeegee is subjected to a drying operation at a temperature above the flow point of the coatings. Alternatively, the two coatings of the first and second squeegee sides may overlap; in this case, there is a region of overlap, preferably on the side facing away from the printing cylinder in operation, so that the quality of the squeegee in operation is not impaired. Under some circumstances, the overlap may alternatively be smoothed in a thermal process step. Moreover, in a first step, both sides may be coated with a coating having the lower proportion by mass of hard material particles (or without hard material particles), and then the first squeegee side is coated in a second step with a coating having the greater proportion by mass of hard material particles. The person skilled in the art is also aware of further methods of achieving the squeegee sides of different proportions by mass of hard material particles.

The squeegees coated in accordance with the invention have high wear resistance and correspondingly a long lifetime. In addition, the working edges of the squeegees of the invention are efficiently stabilized. This results in a sharply bounded contact zone between the squeegee and the printing cylinder or the printing roller, which in turn enables exact stripping-off of printing ink. The contact zone remains largely stable over the entire printing process. Streak formation during the run-in phase in the printing process is also low. Overall, barely any effects that impair the printing process are caused. The squeegee of the invention therefore makes it possible to achieve an essentially constant print quality over the entire printing process. The squeegees are likewise advantageous in applications in the paper industry, for example as coating knives.

In addition, the squeegees of the invention have good sliding properties on the printing cylinders or printing rollers that are typically used, such that, when the squeegees of the invention are used, it is also possible to reduce wear on the printing cylinders or printing rollers. This is also true in relation to sliding properties on paper.

In a particular embodiment, hard material particles are present both in the coating on the first squeegee side and in the coating on the second squeegee side. A proportion by mass of the hard material particles in the coating on the first squeegee side and a proportion by mass of the hard material particles in the coating on the second squeegee side are especially in each case ≥0.1% by weight, in particular ≥1% by weight.

A proportion by mass of the hard material particles in the coating having the higher proportion or in the coating on the first squeegee side is, for example, in the range of 0.1-60% by weight, especially 1-45% by weight, preferably 5-40% by weight or 10-30% by weight. This has been found to be particularly suitable.

A ratio of the proportion by mass of the hard material particles in the coating on the first squeegee side to the proportion by mass of the hard material particles in the coating on the second squeegee side is especially greater than 2, preferably greater than 10, more preferably greater than 100, especially greater than 1,000.

In a particular embodiment, the ratio of the proportion by mass of the hard material particles in the coating on the first squeegee side to the proportion by mass of the hard material particles in the coating on the second squeegee side is, for example, in the range of 2:1-1,000:1, especially 10:1-100:1.

More preferably, the coating of the first squeegee side comprises hard material particles, while the coating of the second squeegee side is essentially free of hard material particles. The expression "essentially free of hard material particles" should be understood to mean that, if hard material particles were present, they have no significant effect, if any, on the wear resistance of the squeegee. However, it will be clear to the person skilled in the art that, as a result of production, a small proportion of hard material particles may nevertheless have been introduced into the second squeegee side, especially in the form of impurities. What is meant in particular thereby is, based on the total weight of the coating of the second squeegee side, a proportion by mass of less than 1%, preferably less than 0.1%, more preferably less than 0.05%. More preferably, the coating of the second squeegee side does not include any hard material particles.

In variants, the second squeegee side may include a significant proportion of hard material particles which thus has a positive effect on the wear resistance of the squeegee. But since the second squeegee side is subject to less stress in the process, according to the invention, the coating of the second squeegee side has a smaller proportion by mass of hard material particles than the first squeegee side.

Preferably, the coating of the second squeegee side does not comprise any particles. Thus, the second squeegee side preferably does not comprise any hard material particles, but also any further particles which can affect, for example, sliding friction or other properties of the squeegee. Since the second squeegee side is subject to much lower mechanical stresses, it may be sufficient when just the first squeegee side comprises particles. It has been found that the wear resistance of the squeegee is generally independent of the nature of the coating of the second squeegee side. Coating of the second squeegee side, for example with a polymer lacquer without particles, may nevertheless be advisable in order for example to protect the squeegee surface from corrosion or else for esthetic reasons.

In variants, the coating of the second squeegee side may have been provided with particles. These can affect, for example, the strength, sliding properties or further properties of the squeegee.

Preference is given to an average volume-equivalent sphere diameter of the hard material particles of less than 1,000 nanometers, preferably less than 500 nanometers, more preferably less than 250 nanometers. The particle size of the hard material particles is advantageously matched to the respective material of the hard material particles.

The volume-equivalent sphere diameter indicates the diameter of a sphere having the same volume as the particle or hard material particle in question. If the particles are porous, the volume of a particle preferably corresponds to the volume of an outer shell of the particle. The average of this value is preferably understood to mean the median of the particle size distribution. Reference is made hereinafter to "particle size" in this connection, but what is meant is the average volume-equivalent sphere diameter.

In variants, instead of the median, it is also possible to use an arithmetic mean of the sphere diameter or, instead of the volume-equivalent sphere diameter, to determine a surface-equivalent sphere diameter.

With particle sizes of this kind, it is possible to optimize the tribological properties of the squeegee of the invention. It has been found that the squeegees with hard material particles in these orders of magnitude have very good wear characteristics with an optimal contact zone between squeegee and printing cylinder or paper substrate.

In principle, the particle sizes chosen may also be greater than 1,000 nanometers. But if the layer thickness is too small, this can have an adverse effect on the quality of the contact zone between squeegee and printing cylinder or paper substrate.

Preferably, the mean volume-equivalent sphere diameter of the hard material particles is greater than 1 nm, more preferably greater than 25 nm, further preferably greater than 50 nm. It has been found that optimal wear resistances of the squeegee are achieved thereby.

Smaller sphere diameters may also be considered according to the thickness of the coating.

A proportion by volume of the hard material particles is preferably 5-30%, more preferably 15-20%.

Proportions of this kind achieve a significant improvement with regard to the wear properties and stability of the working edge.

Smaller proportions by volume are likewise possible, but generally show a less satisfactory improvement in wear resistance. Excessively high proportions by volume of the added component can likewise have an adverse effect on properties of the squeegee. For specific applications, however, higher proportions by volume than 30% are also suitable under some circumstances.

The hard material particles dispersed with preference in the coating may especially be metals, metal oxides, metal carbides, metal nitrides, metal carbonitrides, metal borides, ceramics and/or intermetallic phases.

More preferably, the hard material particles comprise at least one of the following substances: metal oxides, especially aluminum oxide and/or chromium oxide; diamond, silicon carbide, metal carbide, metal nitride, metal carbonitride, boron carbide, cubic boron nitride, tungsten carbide. These materials have been found to be particularly effective for an improvement in the wear characteristics of the coating, especially in connection with the coating comprising a polymer. This coating may comprise exactly one kind of hard material particles.

In an advantageous variant, the hard material particles comprise different particles of at least two different materials. As has been found, this can cause synergistic effects which improve the wear resistance and quality of the squeegee to a much greater degree than expected. Moreover, it may be advantageous when the hard material particles comprise different particles comprising at least two different mean particle sizes.

Further suitable representatives among others are those from the group of $WSi_2$, $Fe_2O_3$, $TiO_2$, $ZrO_2$, $ThO_2$, $SiO_2$, $CeO_2$, $BeO_2$, MgO, CdO, $UO_2$, TiC, VC, ZrC, TaC, $Cr_3C_2$, $ZrB_2$, TiN, $Si_3N_4$, $ZrB_2$, $TiB_2$. Alternatively, other particles, for example organometallic particles, are also possible as an added component for improvement of the wear characteristics of the squeegee. In addition, hard material particles provided may also be further metal nitrides, metal carbonitrides, metal borides, ceramics and/or intermetallic phases. In addition, the hard material particles may also comprise metal particles. Suitable examples are metal particles of W, Ti, Zr, Mo and/or steel. The person skilled in the art is aware of further metals which can be processed to give hard material particles. The metal particles may be used alone, in combination with other metal particles and/or in combination with further hard material particles. In addition, hard material particles composed of metal alloys may be used.

Particularly suitable metal particles have been found to be those composed of metallic molybdenum. Squeegees having a coating based on polymers with metal particles of molybdenum dispersed therein have very high wear resistance and correspondingly also a long lifetime. The working edges of squeegees of this kind have a sharply bounded contact zone between the squeegee and the printing cylinder or the printing roller, which enables more exact stripping-off of printing ink. In a further-preferred variant, the metal particles have an average volume-equivalent sphere diameter of 0.01-0.9 μm and a proportion by volume of 5-30%, more preferably 15-20%.

Squeegees having a polymer-based coating in which there are dispersed metal oxides, metal carbides, metal nitrides, metal carbonitrides, metal borides, ceramics and/or intermetallic phases, especially in conjunction with a polymer-containing or polymer-based coating, have high wear resistance and correspondingly also a long lifetime. Hard material particles of this kind may be embedded in an extremely stable manner in the coating and form a durable composite with the squeegee body. This can improve the strength of the coating overall, and at the same time the working edges of squeegees of this kind have a sharply bounded contact zone between the squeegee and the printing cylinder or the printing roller, which again enables more exact stripping-off of printing ink. The same also applies to applications in papermaking.

Especially the following metal carbides and/or metal nitrides have been found to be particularly suitable: $B_4C$, cubic BN, TiC, WC and/or SiC. In the case of the metal oxides, $Al_2O_3$ in particular is advantageous.

However, the hard material particles need not necessarily be in the form of metal particles, metal oxides, metal carbides, metal nitrides, metal carbonitrides, metal borides, ceramics and/or intermetallic phases. In principle, particles of other materials are also useful as hard material particles.

In an advantageous variant, the hard material particles comprise diamond. Preference is given here to using diamond having mono- and/or polycrystalline structure. Hard material particles of diamond have been found to be particularly advantageous in the case of the squeegees of the invention and especially bring a further improvement in the wear resistance and stabilization of the working edges of the squeegee. This is likely to be attributable to factors including the high hardness and chemical and mechanical stability of diamond.

As has been shown, however, it is possible, in principle, in place of or in addition to hard material particles of diamond having mono- and/or polycrystalline structure, to use particles of amorphous diamond-like carbon ("DLC"). Advantageously, however, the amorphous diamond-like carbon has a high $sp^3$ hybridization level, in order that the hardness is sufficient. According to the end use of the squeegee, amorphous diamond-like carbon can even have advantages. In general, amorphous diamond-like carbon is additionally less costly than diamond.

More preferably, the hard material particles comprise both SiC and diamond, where, further preferably, a particle size of the SiC is greater than a particle size of the diamond. More particularly, the hard material particles comprise SiC with a particle size of 0.7-0.9 μm and diamond with a particle size of 5 nm-0.9 μm, preferably 200-300 nm.

Alternatively, it is possible to choose different particle sizes of SiC and diamond, such that, for example, the particle size of the diamond is equal to or greater than the particle size of the SiC. Moreover, other combinations of hard material particles are also possible, in which case it is also possible to combine more than two, for example three, four or even more, different hard material particles with one another.

In another preferred variant of the invention, the hard material particles comprise, for example, both SiC and cubic BN, where a particle size of the BN preferably corresponds roughly to the particle size of the SiC. More preferably, the particle sizes of the SiC and the cubic BN are about 0.1-0.9 μm.

In addition, it has been found to be advantageous for certain applications when the coating, for improvement of wear resistance, comprises lubricants, especially lubricant particles. As a result, it is additionally possible to achieve a lubricant effect, which reduces wear, in the squeegeeing-off. Useful lubricants or lubricant particles in principle include substances which cause a reduction in sliding friction between squeegee and printing cylinder and at the same time are especially sufficiently stable, such that no impairment or soiling of the printing cylinder occurs.

Examples of useful materials include polymeric thermoplastics, e.g. perfluoroalkoxyalkane and/or polytetrafluoroethylene, and also graphite, molybdenum disulfide and/or soft metals, for example aluminum, copper and/or lead.

An example of a lubricant of good suitability is polytetrafluoroethylene (PTFE). Polytetrafluoroethylene is preferably used in the form of lubricant particles.

Particularly the use of polymeric thermoplastics, but also in the case of other polymers, there is the advantage that these lubricants can be incorporated particularly efficiently into the matrix of the coating, especially since the coating of the invention is polymer-based.

An alternative, particularly advantageous lubricant has been found to be hexagonal BN. Especially in particulate form. As has been shown, it has been possible with lubricants, especially lubricant particles of hexagonal BN, to improve the wear resistance of the squeegee in a multitude of applications with different printing cylinders. More particularly, this is largely independent of the process parameters in the squeegeeing-off. In other words, hexagonal BN has been found to be an extremely versatile and effective lubricant.

Lubricant particles, especially lubricant particles of hexagonal BN, advantageously have a particle size of 50 nm-0.9 μm, preferably 80-300 nm, further preferably 90-110 nm. This achieves an optimal effect for a multitude of applications. In principle, however, other particle sizes may also be suitable for specific applications.

In a particularly preferred embodiment, both lubricants, especially lubricant particles, and hard material particles are present as additives in the coating for improvement of wear resistance. Ideally, lubricant particles of hexagonal BN are used together with hard material particles of SiC.

In a further advantageous embodiment, the coating comprising a polymer advantageously includes less than 50% by weight, especially less than 25% by weight, preferably less than 10% by weight, in particular less than 5% by weight, even more preferably less than 2% by weight, very specifically less than 1% by weight or less than 0.1% by weight, of particulate lubricants. These are especially particulate organic lubricants, very particularly particulate polymer-based lubricants, for example particulate polytetrafluoroethylene (PTFE).

In a particular embodiment, all coatings advantageously include less than 50% by weight, especially less than 25% by weight, preferably less than 10% by weight, in particular less than 5% by weight, even more preferably less than 2% by weight, very specifically less than 1% by weight or less than 0.1% by weight, of particulate lubricants. In particular, all coatings of the squeegee are essentially free of particulate lubricants.

By virtue of the coating comprising a polymer or the polymer-based coatings, it is possible to dispense with lubricant particles if required without any significant deterioration in the sliding and stripping properties of the squeegee. This significantly simplifies the production. The polymer-comprising coatings in most applications already show very good sliding and stripping properties, which in some cases are even better than in the case of conventional squeegees and can still be enhanced in a simpler manner if need be by nonparticulate lubricants.

In a further embodiment, the coating comprises, in addition to the hard material particles, fibers for reinforcement of the coating. The fibers may comprise, for example, carbon fibers, polymer fibers or the like.

A layer thickness of the coating is preferably 1-30 μm (micrometers). Further preferably, the layer thickness is 5-20 μm, more preferably 5-10 μm. Layer thickness of this kind offer optimal protection of the working edge of the squeegee. Moreover, such a layer thickness have high intrinsic stability, which effectively reduces the partial or complete delamination of the first coating, for example during the squeegeeing of printing ink off a printing cylinder.

Thicknesses of less than 1 μm are possible, but the wear resistance of the working edge or the squeegee decreases rapidly. Greater thicknesses than 30 μm are also implementable. However, these are generally less economic and can under some circumstances also adversely affect the quality of the working edge. For specific fields of use of the squeegee, however, thicknesses of less than 1 μm or more than 30 μm may indeed be advantageous.

In a particularly preferred embodiment, the squeegee, as well as the coating comprising a polymer, has at most three and especially at most two further coatings, preferably at most one and in particular no further coating. Most preferably, the coating of the squeegee consists solely of the coating comprising a polymer and optionally an adhesion coating. This firstly simplifies the production; secondly, coatings with few or no additional coatings have been found to be particularly reliable and robust. Incompatibilities between different coatings can thus be reduced or entirely avoided.

For specific applications, other coating structures may alternatively be advantageous.

Preferably, the squeegee body has been formed from a metal or a metal alloy. Particularly advantageous squeegee bodies are those composed of metals which are robust and corrosion-resistant. For these reasons in particular, squeegee bodies made of aluminum are particularly advantageous. Moreover, squeegee bodies may alternatively be manufactured from other metals, for example iron etc. Alternatively, the squeegee may be manufactured from a metal alloy, which means that the desired properties of the squeegee can be optimally controlled. The choice of material for the squeegee body is preferably matched to the coating such that optimal wear resistance of the squeegee and hence a maximum lifetime are achieved, and precise squeegeeing-off is enabled.

In variants, it is also possible to use other materials for the production of the squeegee body.

In a particularly preferred embodiment, the squeegee body consists of steel. From a mechanical point of view, steel has been found to be a particularly robust and suitable material for the squeegee of the invention. It is thus possible in a precise manner to inexpensively produce squeegees with long lifetime.

Rather than steel, however, it is also possible, for example, to use other metals or metal alloys as main bodies.

Preferably, in this case, at least one shall region of the main body present with respect to the longitudinal direction is covered completely and all-round of a coating. As a result, at least the working edge, the top side, the bottom side and the rear end face of the main body at the opposite end from the working edge have been covered with a coating. The lateral faces of the main body present perpendicularly to the longitudinal direction may be uncoated. Alternatively, it is also within the scope of the invention that the second coating covers the main body completely and on all sides, meaning that the lateral faces of the main body present perpendicularly to the longitudinal direction are also covered with one of the coatings. In this case, at least one of the coating surrounds the main body completely.

By virtue of at least the shell region, present with respect to the longitudinal direction, of the main body being covered completely and all-round with a coating, the essential regions of the main body that do not form part of the working edge have also been provided with the coating. This is especially advantageous in order to protect the main body from the water-based or slightly acidic printing inks and/or other liquids that come into contact with the squeegee. In the case of main bodies made of steel in particular, optimal rust protection for the squeegee is thus provided. This further improves the constancy of the print quality during the printing process, since the printing cylinder in contact with the squeegee during the printing process or the printing roller is not contaminated, for example, by rust particles. Furthermore, the main body is given the best possible protection from rust formation by a coating applied in the shell region during storage and/or transport as well.

In a further aspect of the invention, however, the squeegee has been coated only where the greatest mechanical stress occurs, namely at the working edge and the peripheral regions thereof. This allows the coating to be kept inexpensive. This variant is especially advantageous in the case of squeegee bodies which are essentially chemically inert, especially to the field of use of the squeegee. For example, squeegee bodies made of stainless steel or aluminum may optionally not be coated only in the region of the working edge or on the side remote from the printing cylinder in operation. It is thus possible to reduce the material costs in the production.

In a further preferred embodiment, the squeegee body is formed from a plastic or from a plastics material. For specific applications, main bodies made of plastics have been found to be more advantageous in some cases compared to main bodies made of steel owing to their different mechanical and chemical properties. For instance, some of the plastics under consideration have sufficient chemical stability or inertness toward typical water-based and slightly acidic printing inks, which means that the main body does not have to be given special protection as in the case of a main body made of steel. Moreover, plastics are less costly to purchase and easy to process. Moreover, plastics are lighter and hence also preferable in use, especially in handling in the case of maintenance of printing machines and the like. The squeegee bodies made of plastic also have good properties in the case of coating with a polymer-based coating. For instance, the squeegee body may be bonded to the coating not just in a purely adhesive manner as in the case of squeegee bodies made of metal, but optionally also in a chemical manner, or thermally fused to the coating in an interphase.

Useful plastics materials include, for example, polymer materials. These may include thermoplastic, thermoset and/or elastomeric polymer materials. Suitable plastics are, for example, polyethylene, polypropylene, polyvinyl chloride, polystyrene, polyvinyl alcohol, polyethylene terephthalate, polyamide, polyacetal, polycarbonate, polyarylate, polyetheretherketone, polyimide, polyester, polytetrafluoroethylene and/or polyurethane. Composite structures with fibers for reinforcement of the polymer matrix are also possible.

In principle, however, it is also possible to use main bodies consisting, for example, both of metal, especially steel, and of plastic. Main bodies comprising other materials, for example ceramics and/or composite materials, may possibly also be suitable for specific applications.

Preferably, the squeegee body is heated prior to the coating. This firstly ensures that the squeegee body is dry for the coating. In this way, it is possible to prevent, for example, later detachment of a coating from the squeegee body, for example as a result of corrosion of the squeegee body beneath the coating. This further achieves optimal adhesion or bonding of the coating on the squeegee body. The polymer-based coating thus has a lower viscosity on the squeegee, which means that the coating can be distributed homogeneously without forming streaks or droplets. If the coating material to be applied comprises solvent, this can further promote the drying operation.

In variants, it is possible to also dispense with the heating of the squeegee body prior to the coating.

It may further be advantageous when the squeegee body is roughened, especially mechanically roughened, prior to the coating. This can further improve the adhesion between squeegee body and coating. However, this is not absolutely necessary.

In particular, the coating of the squeegee body with the coating comprising a polymer may be preceded by application of an adhesion coating. This can be effected in addition to or instead of the roughening and likewise enables an improvement in the adhesion between squeegee body or any layers already applied and the coating of the invention.

After the application of the adhesion coating and before the coating of the squeegee body with the coating comprising a polymer, an intermediate drying step may optionally additionally be effected. This may be advantageous according to the adhesion coating.

Preferably, the squeegee body is mechanically and/or electrolytically degreased prior to the coating. Preference is given to electrolytic degreasing. This in turn achieves an optimal bond between the coating and the squeegee body. Contamination present on the squeegee, especially greasy contamination, can severely disrupt the adhesion between coating and squeegee body.

In variants, it is also possible to dispense with electrolytic degreasing. In this case, it is possible to resort to another cleaning step, for example to a cleaning step with a wash solution, for example an organic solvent or a soap solution.

Preferably, the squeegee is connected as the anode for electrolytic degreasing, in order to remove grease from the squeegee body by means of cations. In what is called anodic degreasing, oxygen is formed at the squeegee body beneath the grease layer, which detaches the grease layer. Anodic degreasing has the particular advantage over cathodic degreasing that hydrogen embrittlement can be avoided. The elevated power demand compared to cathodic degreasing, particularly in the case of squeegees made of steel, is therefore consciously accepted in order to conserve the squeegee body.

The degreasing can alternatively also be conducted with switched electrodes, as cathodic degreasing. This has the advantage that the formation of hydrogen beneath the grease layer with the same amount of current can produce twice the gas volume. However, under some circumstances, hydrogen embrittlement has to be accepted. In the case of squeegee bodies that are not subject to hydrogen embrittlement, however, it is possible to choose cathodic degreasing without difficulty in order to obtain more efficient degreasing for a lower power consumption. In addition, the two techniques can also be employed sequentially.

Preferably, the coating of the squeegee body is followed by a drying step, and the drying step is especially followed by a hardening step. In the drying step, any solvents present in the coating can be gently removed, while, in the hardening step, even the smallest residual amounts of solvents are removed and the structure of the coating is cured. The hardening step may be purely thermal, meaning that, for example, the coating with the or on the squeegee body baked.

Secondly, a chemical process can also be started by the hardening step. This may include, for example, a polymerization which is started by UV rays. The person skilled in the art is also aware of further steps of this kind which can follow a polymer-based coating.

In variants, it is also possible to dispense with the drying step and/or the hardening step.

Preferably, the hardening step is effected at a temperature of 150° C. to 350° C., preferably at 200° C. to 300° C., especially at 230° C. to 270° C. More particularly, these temperatures are maintained over a holding period of 0.5-15 hours, preferably 0.5-8 hours. Temperatures and holding times of this kind have been found to be optimal in order to achieve sufficient hardening of the coatings.

Temperatures of less than 100° C. are likewise possible. In this case, however, very long and usually uneconomic holding times are required. Higher temperatures than 350° C., according to the material of the main body and the coating, are also implementable in principle, but it should be ensured that the polymer-containing coating in particular is not damaged by the hardening step.

Preferably, after the complete curing, in the hardening step, the coating is subjected to an aftertreatment. Particular preference is given here to a mechanical aftertreatment and/or a cleaning operation. For example, a mechanical processing operation can be conducted, such as grinding, lapping or polishing the coating, or a treatment using suitable tools, for example blades, mills or the like.

In variants, it is also possible to dispense with the aftertreatment.

Further advantageous embodiments and combinations of features of the invention will be apparent from the detailed description which follows and the entirety of the claims.

BRIEF DESCRIPTION OF THE DRAWINGS

The drawings used to elucidate the working example show.

In principle, identical parts in the figures are given identical reference numerals.

WAYS OF EXECUTING THE INVENTION

Figure 1:
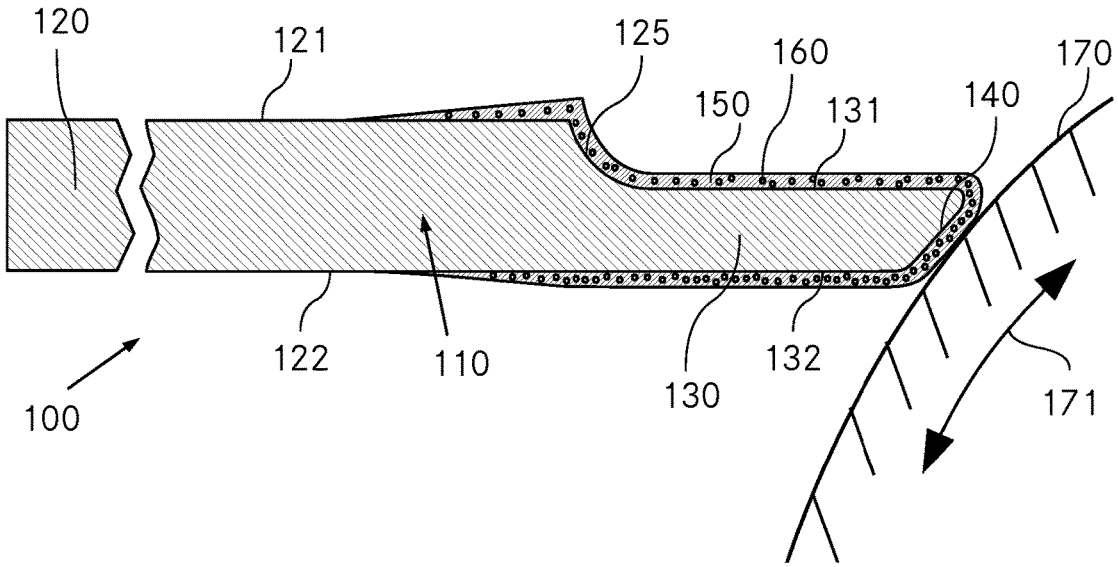
FIG. 1 a cross section through a first lamellar squeegee of the invention, wherein a working edge of the lamellar squeegee has been coated with a polymer-based coating and hard material particles dispersed therein.

FIG. 1 shows an inventive lamellar squeegee 100 in contact with a printing roller 170 in cross section. The lamellar squeegee 100 comprises a main body 110 made of steel, which, on the left-hand side in FIG. 1, has a rear region 120 having an essentially rectangular cross section. The rear region 120 here has been provided as a securing region in order to hold the lamellar squeegee, for example, in a corresponding receiving apparatus of a printing machine. A squeegee thickness, measured from the top side 121 to the bottom side 122 of the rear region, is about 0.2 mm. A length of the main body 110 or of the lamellar squeegee 100 measured perpendicularly to the plane of the sheet is, for example, 1000 mm. The printing roller 170 may have a clockwise or counterclockwise direction of rotation 171. In the case of applications in flexographic printing, both directions of rotation are possible. In gravure printing, the printing roller in the present arrangement is rotated clockwise.

On the right-hand side in FIG. 1, the main body 110 is tapered in stages from the top side 121 of the rear region 120 to form a working edge 130. A top side 131 of the working edge 130 lies in a plane beneath the plane of the top side 121 of the rear region 120, but is formed so as to be essentially parallel or plane-parallel to the top side 121 of the rear region 120. Between the rear region 120 and the working edge 130 there is a concave-shaped transition region 125. The bottom side 122 of the rear region 120 and the bottom side 132 of the working edge 130 are in a common plane, which is plane-parallel to the top side 121 of the rear region 120 and plane-parallel to the top side 131 of the working edge 130. A width of the main body 110, measured from the end of the rear region as far as the end face 140 of the working edge 130, measures 40 mm for example. A thickness of the working region 130, measured from the top side 131 to the bottom side 132 of the working region, is, for example, 0.060-0.150 mm, which corresponds to about half the squeegee thickness in the rear region 120. A width of the working region 130 measured at the top side 131 of the working region 130 from the end face 140 as far as the transition region 125 is, for example, 0.8-5 mm.

A free end face 140 of the free end of the working edge 130 runs from the top side 131 of the working edge 130 obliquely downward to the bottom side 132 of the working edge 130. The end face 140, with respect to the top side 131 of the working edge 130 and with respect to the bottom side 132 of the working edge 130, has an angle of about 45° and 135° respectively. An upper transition region between the top side 131 and the end face 140 of the working edge 130 is rounded. Likewise rounded is a lower transition region between the end face 140 and the bottom side 132 of the working edge 130.

The working edge 130 of the lamellar squeegee 100 is additionally surrounded by a coating 150. The coating 150 completely covers the top side 131 of the working edge 130, the transition region 125 and a subregion of the top side 121 of the rear region 120 of the main body 110 that adjoins said transition region 125. The coating 150 likewise covers the end face 140, the bottom side 132 of the working edge 130, and a subregion of the bottom side 122 of the rear region 120 of the main body 110 that adjoins the bottom side of the working edge 130.

The coating 150 is a polymer-based coating; for example, the coating comprises epoxy resin, where the epoxy resin content in the ready-to-use coating is, for example, about 70% or 80% by weight, according to the squeegee side (see below). Dispersed therein are hard material particles 160, for example of silicon carbide (SiC). An average particle size of the hard material particles 160 is about 0.8 μm. The layer thickness of the first coating 150 in the region of the working edge 130 measures 15 μm for example. In the region of the top side 121 and the bottom side 122 of the rear region 120, the layer thickness of the first coating 150 decreases continuously, such that the first coating 150 tapers in a wedge-like manner in a direction away from the working edge 130.

The proportion by mass of hard material particles 160 in the coating of the first side of the squeegee 100 facing the printing roller is higher than in the coating of the second side of the squeegee facing away from the printing roller. The first side comprises the end face 140 and the bottom side 132 of the working edge 130. The second side comprises the top side 131 of the working edge 130. The proportion by mass of hard material particles 160 in the coating of the first side is, for example, 20% by weight, and the proportion by mass of epoxy resin in the coating of the same side is, for example, 70% by weight. The proportion by mass of hard material particles 160 in the coating of the second side is, for example, 10% by weight, and the proportion by mass of epoxy resin in the coating of the same side is, for example, 80% by weight. Thus, the second side of the squeegee 100 has a lower content of hard material particles 160 than the first side of the squeegee 100.

The first side, i.e. the side facing the printing roller 170, thus includes the contact region between squeegee 100 and printing roller 170, namely the end face 140. Moreover, the first side also includes that surface 122 of the squeegee which forms an angle of less than 90° with a tangent in the contact region of the squeegee. The same interpretation also applies to FIGS. 2 and 3 which follow.

Figure 2:
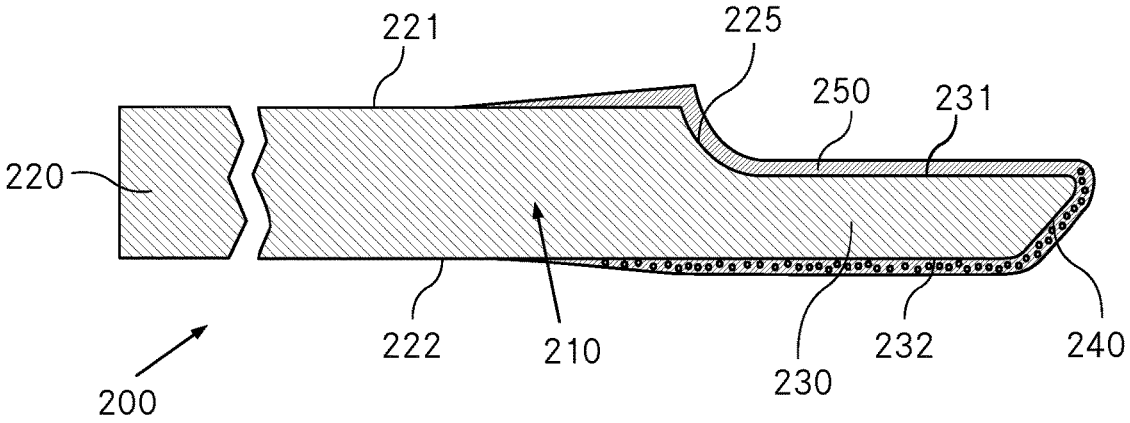
FIG. 2 a cross section through a second lamellar squeegee of the invention, wherein a working edge of the lamellar squeegee has been coated with a polymer-based coating and hard material particles dispersed therein.

FIG. 2 shows a second inventive lamellar squeegee 200 in cross section. The second lamellar squeegee 200 has a main body 210 with a rear region 220 and a working edge region 230, and is essentially of the same design as the first lamellar squeegee 100 from FIG. 1. In the case of the second lamellar squeegee 200, the top side 231 of the working edge 230, the transition region 225, and a subregion of the top side 221 of the rear region 220 of the main body 210 that adjoins said transition region 225, and also the end face 240, the bottom side 232 of the working edge 230, and a subregion of the bottom side 222 of the rear region 220 of the main body 210 that adjoins the bottom side 232 of the working edge 230 are likewise coated with a coating 250.

The coating 250 again consists of a polymer-based coating, for example phenol-formaldehyde resin. The coating of the first side of the squeegee 200 facing the printing roller comprises hard material particles 260, while the coating of the second side of the squeegee facing away from the printing roller comprises no or essentially no hard material particles. The first side here again includes the end face 240 and the bottom side 232 of the working edge 230. The second side comprises the top side 231 of the working edge 230. The hard material particles are cubic $B_4O$ for example.

On the first side of the squeegee 200, the ready-to-use coating has a content of phenol-formaldehyde resin of, for example, 80% by weight. The coating of the first side further includes a content of cubic $B_4O$ of 15% by weight. The second side of the squeegee 200 has a content of phenol-formaldehyde resin of, for example, 95% by weight. The second side of the squeegee 200 is essentially free of particles.

An average particle size of the hard material particles 260 is about 0.6 μm. The layer thickness of the first coating 250 in the region of the working edge 230 measures 17 μm for example.

Figure 3:
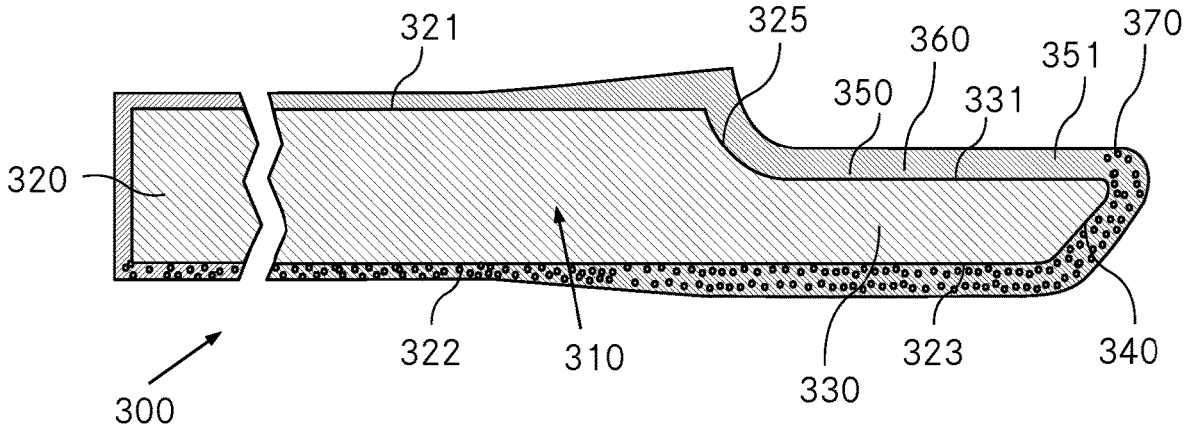
FIG. 3 a cross section through a third lamellar squeegee of the invention, which has been fully coated with a polymer-based coating and hard material particles dispersed therein.

FIG. 3 shows a third inventive lamellar squeegee 300 in cross section. The third squeegee 300 has a main body 310 coated in the region of the working edge 330 with a coating 350 in the same way as the first squeegee from FIG. 1. Correspondingly, the top side 331 of the working edge 330, the transition region 325, and a subregion of the top side 321 of the rear region 320 of the main body 310 that adjoins said transition region 325, and also the end face 340, the bottom side 332 of the working edge 330 and a subregion of the bottom side 322 of the rear region 320 of the main body 310 that adjoins the bottom side 332 of the working edge 330 have been covered with the coating 350.

In the case of the third lamellar squeegee, there is a coating 350 which completely surrounds the lamellar squeegee 300. In other words, the coating 350 completely covers both the top side 321 and the bottom side 322 of the rear region 320 of the main body 310.

The coating 350 in turn consists of a polymer-based coating, for example polyamide. The coating of the first side of the squeegee 300 facing the printing roller comprises hard material particles 360, while the coating of the second side of the squeegee facing away from the printing roller comprises no or essentially no hard material particles. The first side here again includes the end face 340 and the bottom side 332 of the working edge 330. The second side comprises the top side 331 of the working edge 330. The hard material particles are tungsten particles for example.

On the first side of the squeegee 300, the ready-to-use coating has a content of polyamide of 85% by weight for example. The coating of the first side further comprises a content of tungsten particles of 8% by weight. The second side of the squeegee 300 has a content of phenol-formaldehyde resin of 93% by weight for example. The second side of the squeegee 200 is in turn essentially free of particles.

An average particle size of the hard material particles 360 is about 0.3 μm. The layer thickness of the first coating 350 in the region of the working edge 330 measures 12 μm for example.

The above-described lamellar squeegees shown in FIGS. 1-3 should be regarded merely as illustrative examples for a multitude of implementable embodiments.

Figure 4:
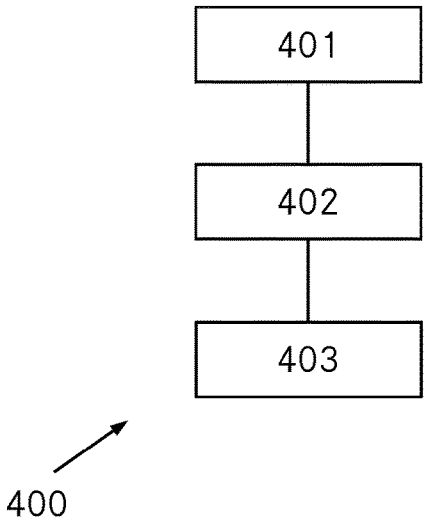
FIG. 4 a schematic diagram of a method of the invention for production of a squeegee.

FIG. 4 illustrates a process 400 for production of a lamellar squeegee as depicted, for example, in FIG. 1. In this process, in a first step 401, the squeegee is electrolytically degreased. This is done by connecting the squeegee 100 as the anode for electrolytic degreasing, in order to remove grease from the squeegee body 110. The anodic electrolytic degreasing avoids hydrogen embrittlement. Subsequently, the squeegee body 110 is heated. In a second step 402, coating with the polymer-based coating material is effected, in which the hard material particles and any further particles have been dispersed and/or other auxiliaries have been introduced. In the last step 403, a drying and hardening step is effected.

However, the above-described embodiments and the production process should be regarded merely as illustrative examples which can be modified as desired in the context of the invention.

For instance, the main bodies 110, 210, 310 of the squeegees from FIGS. 1-3 may also have been manufactured from a different material, for example stainless steel or a carbon steel. 3 In principle, the main bodies of the squeegees from FIGS. 1-3 may alternatively consist of a nonmetallic material, for example plastics. This may be advantageous particularly for applications in flexographic printing.

It is also possible, rather than the main bodies shown in FIGS. 1-3, to use main bodies having a different shape in each case. More particularly, the main bodies may have a wedge-shaped working edge or a non-tapering cross section with a rounded working edge. The free end faces 140, 240, 3403 of the working edges 130, 230, 330 may, for example, also have a fully rounded shape.

In addition, the inventive squeegees from FIGS. 1-3 may also have different dimensions. For example, the thicknesses of the working regions 130, 230, 330, measured from the respective top sides 131, 231, 331 to the respective bottom sides 132, 232, 332, may vary within a range of, for example, 0.040-0.200 mm.

The coatings of the squeegees from FIGS. 1-3 may likewise contain further coating components and/or additional substances, for example metal atoms, nonmetal atoms, inorganic compounds and/or organic compounds. More particularly, it is possible to provide different lubricants or substances which affect the hardness of the coating. The additional substances may also be particulate.

All the squeegees shown in FIGS. 1-3 may be coated, for example, with one or more further coatings. The further coatings may be present in the region of the working edges and/or the rear regions and, for example, improve the wear resistance of the working edges and/or protect the rear region from influences by aggressive chemicals. Any further coating is preferably likewise polymer-based. In variants, it is alternatively possible to use other coating types.

In summary, it can be stated that novel squeegees have been created which feature good wear resistance and enable homogeneous and streak-free stripping-off of printing ink over their entire lifetime and are additionally inexpensive to produce. At the same time, the squeegees of the invention can be implemented in a wide variety of different embodiments, and so they can be adapted in a controlled manner to specific end uses.

The invention claimed is:

1. A squeegee comprising a squeegee body having a working edge and a first squeegee side and a second squeegee side, where the squeegee body has been provided with a coating comprising a polymer, where the coating comprises particles at least in one subregion, whereby the particles take the form of hard material particles and in that a proportion by mass of the hard material particles in the coating on the first squeegee side is higher than a proportion by mass of the hard material particles in the coating on the second squeegee side, whereby the polymer in the coating forms a continuous phase and/or a dispersion medium for the hard material particles in the coating and the hard material particles are dispersed and/or embedded in the continuous phase of the polymer.

2. The squeegee as claimed in claim 1, wherein the coating of the first squeegee side comprises hard material particles and the coating of the second squeegee side is essentially free of hard material particles.

3. The squeegee as claimed in claim 2, wherein the coating of the second squeegee side does not comprise any particles.

4. The squeegee as claimed in claim 1, wherein the hard material particles comprise at least one of the following substances:

a) metal oxides, especially aluminum oxide and/or chromium oxide;
b) diamond;
c) silicon carbide;
d) metal carbide;
e) metal nitride;
f) metal carbonitride;
g) boron carbide;
h) cubic boron nitride;
i) tungsten carbide.

5. The squeegee as claimed in claim 1, wherein the squeegee body has been formed from a metal or a metal alloy.

6. The squeegee as claimed in claim 5, wherein the squeegee body consists of steel.

7. The squeegee as claimed in claim 1, wherein the squeegee body has been formed from a plastic.

8. A process for producing a squeegee, where, in a squeegee body with a working edge, a first squeegee side and a second squeegee side is coated with a coating comprising a polymer and comprising particles at least in one subregion, wherein the particles take the form of hard material particles and in that a proportion by mass of the hard material particles in the coating on the first squeegee side is higher than a proportion by mass of the hard material particles in the coating on the second squeegee side.

9. The process as claimed in claim 8, wherein the squeegee body is heated prior to the coating.

10. The process as claimed in claim 8, wherein the squeegee body is roughened prior to the coating.

11. The process as claimed in claim 8, wherein the squeegee body is mechanically or electrolytically degreased prior to the coating.

12. The process as claimed in claim 10, wherein the squeegee is connected as the anode for electrolytic degreasing in order to remove grease from the squeegee body by means of cations.

13. The process as claimed in claim 8, wherein the coating of the squeegee body with the coating comprising a polymer is preceded by application of an adhesion coating.

14. The process as claimed in claim 13, wherein the application of the adhesion coating is followed and the coating of the squeegee body with the coating comprising a polymer is preceded by an intermediate drying step.

15. The process as claimed in claim 8, wherein the coating of the squeegee body is followed by a drying step.

16. The process as claimed in claim 15, where the drying step is followed by a hardening step.

17. The process as claimed in claim 16, wherein the hardening step is effected at a temperature of 150° C. to 350° C.

18. The squeegee as claimed in claim 1, wherein the coating comprising the polymer comprises more than 50% by weight of polymers.

19. The squeegee as claimed in claim 1, wherein the polymer is a thermoset.

20. The squeegee as claimed in claim 1, wherein the coating comprising the polymer includes a total of less than 5% by weight of nickel.

21. The squeegee as claimed in claim 1, wherein the coating comprising the polymer is free of nickel.

22. The squeegee as claimed in claim 1, wherein the coating comprising the polymer less than 5% by weight particulate polytetrafluoroethylene (PTFE).

23. The squeegee as claimed in claim 1, wherein the coating comprising the polymer comprises more than 50% by weight of polymers, and the polymer is a thermoset, and the coating comprising the polymer is free of nickel and free of particulate polytetrafluoroethylene (PTFE).

24. The squeegee as claimed in claim 19, wherein the thermoset comprises epoxy resins, phenolic resins, phenol-formaldehyde resins, melamine-formaldehyde resins, saturated and unsaturated polyester resins, or mixtures thereof.

* * * * *